United States Patent [19]

Augoyard

[11] Patent Number: 4,636,110

[45] Date of Patent: Jan. 13, 1987

[54] SLIDING FORMWORK MACHINE WITH TWO EXTRUDING PLATES FOR CONSTRUCTING CONTINUOUSLY REINFORCED CONCRETE ROADWAYS

[75] Inventor: Jean-Pierre Augoyard, Domont, France

[73] Assignee: GTM-Entrepose, Nanterre Cedex, France

[21] Appl. No.: 670,961

[22] Filed: Nov. 13, 1984

[30] Foreign Application Priority Data

Nov. 17, 1983 [FR] France ..... 83 18284
Sep. 21, 1984 [FR] France ..... 84 14518

[51] Int. Cl.[4] ..... E01C 19/18; E01C 19/48; E01C 23/04

[52] U.S. Cl. ..... 404/100; 404/105

[58] Field of Search ..... 404/74, 82, 87, 88, 404/100, 98, 105, 102

[56] References Cited

U.S. PATENT DOCUMENTS

| | | | |
|---|---|---|---|
| 2,068,702 | 1/1937 | Poulson | 404/82 |
| 2,087,191 | 7/1937 | Heltzel | 404/88 |
| 2,175,240 | 10/1939 | Arthur | 404/100 |
| 2,224,194 | 12/1940 | Mitchell | 404/88 |
| 2,389,773 | 11/1945 | Golden | 404/88 |
| 2,399,025 | 4/1946 | Heltzel | 404/88 |
| 3,098,415 | 7/1963 | Guntert et al. | 404/102 |
| 3,331,296 | 7/1967 | Perkins et al. | 404/100 |
| 3,566,758 | 3/1971 | Perkins | 404/100 |
| 3,657,977 | 4/1972 | Hudis | 404/100 |
| 3,849,016 | 11/1974 | Cochrane et al. | 404/100 |
| 4,066,723 | 1/1978 | King et al. | 404/82 X |
| 4,073,592 | 2/1978 | Godberson et al. | 404/82 |
| 4,074,802 | 2/1978 | Hudis | 404/101 |
| 4,384,806 | 5/1983 | Taylor, Jr. | 404/105 X |
| 4,493,585 | 1/1985 | Axer | 404/102 |

*Primary Examiner*—Stephen J. Novosad
*Assistant Examiner*—Matthew Smith
*Attorney, Agent, or Firm*—Philip H. Gottfried

[57] ABSTRACT

A sliding shuttering machine for constructing continuously reinforced concrete roadways or pavements, comprising a main frame provided with transversely spaced ground engaging members allowing it to move over the ground, two lateral shutterings spaced apart transversely and extending longitudinally between the ground engaging members, a main extrusion plate extending transversely between the lateral shutterings and forming therewith a tunnel shaped sliding shuttering for extruding a mass of concrete and molding same into a thick pavement as the machine moves forward, adjustment means mounted between said main frame and said main extrusion plate for adjusting the vertical position thereof with respect to the ground and, consequently, the thickness of the concrete pavement to a desired value, an additional extrusion plate which extends transversely between the lateral shutterings and which is situated at a distance in front of said main extrusion plate and at a height with respect to the ground which is less than that of the main extrusion plate, vibrator means mounted in front of said additional extrusion plate, concrete supply and distribution means being arranged for delivering a mass of concrete in front of the main and the additional extrusion plates, and a first set of guide elements, spaced apart transversely, which are mounted under said additional extrusion plate for guiding continuous longitudinal reinforcements to be buried in the concrete pavement.

20 Claims, 17 Drawing Figures

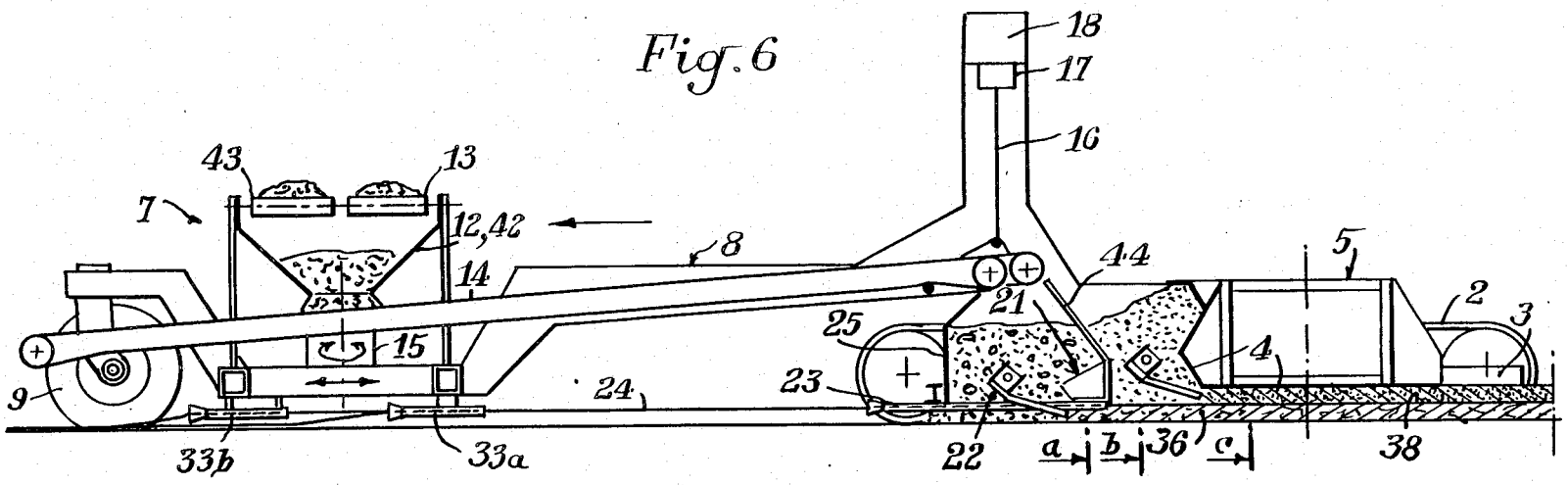
Fig. 6
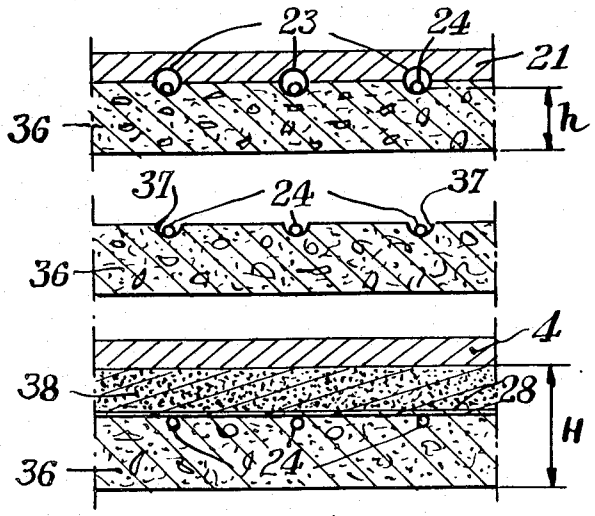
Fig. 7a
Fig. 7b
Fig. 7c

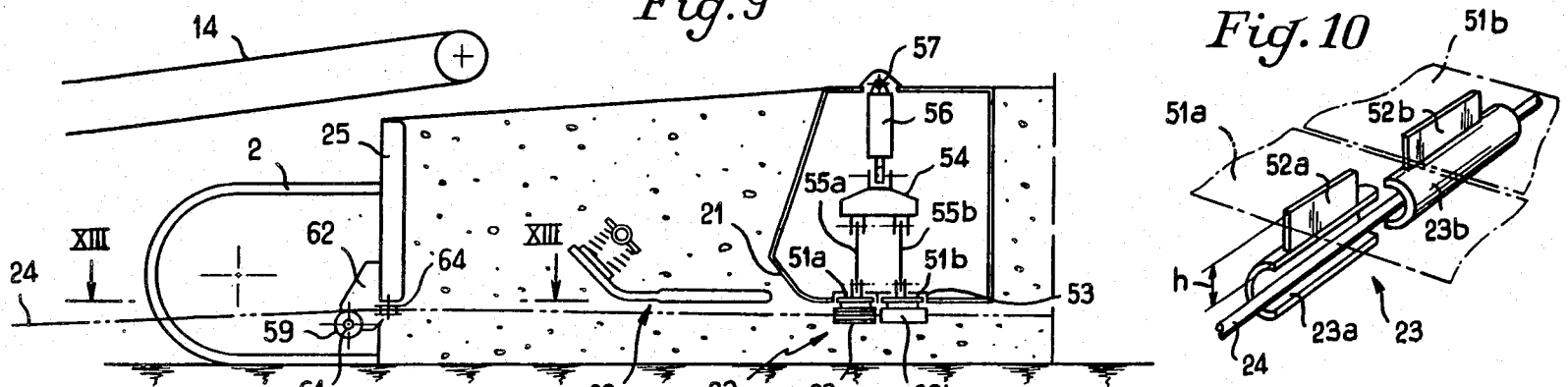
Fig. 9
Fig. 10
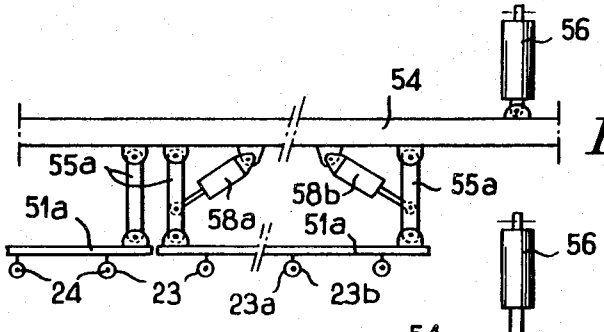
Fig. 11
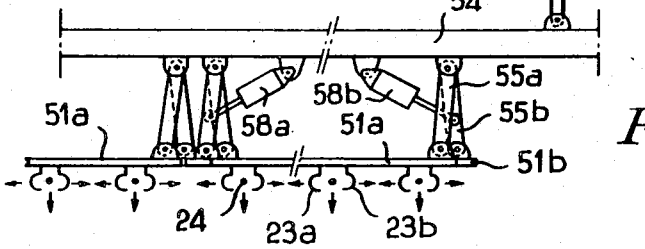
Fig. 12
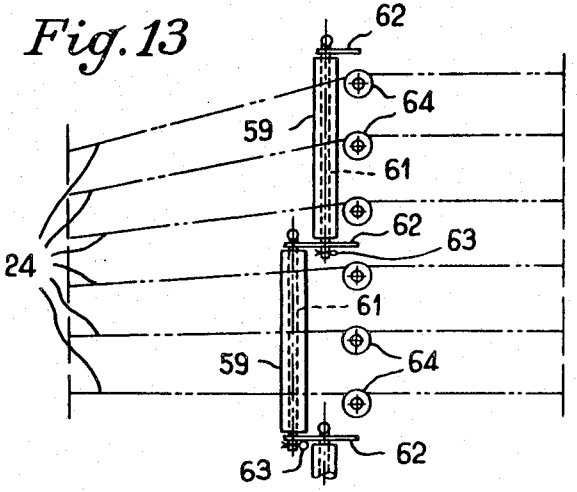
Fig. 13

SLIDING FORMWORK MACHINE WITH TWO EXTRUDING PLATES FOR CONSTRUCTING CONTINUOUSLY REINFORCED CONCRETE ROADWAYS

BACKGROUND OF THE INVENTION

1. Field of the Invention

The present invention relates to a sliding shuttering or formwork machine for constructing continuously concrete roadways or pavements, of the type comprising a main frame having transversely spaced ground engaging members allowing it to move over the ground, two lateral transversely spaced shutterings or side forms extending longitudinally between the ground engaging members, a conforming plate, sometimes also referred to in the art as a "slipform pan" or as an "extrusion plate", and hereinafter called the "main extrusion plate", said main extrusion plate extending transversely between the lateral shutterings and forming therewith a tunnel shaped sliding shuttering or formwork for extruding a mass of concrete and molding same into a thick pavement as the machine moves forward, the main extrusion plate being mounted for vertical movement with respect to the main frame, adjustment means mounted between the main frame and the main extrusion plate for adjusting the vertical position thereof with respect to the ground and, consequently, the thickness of the concrete pavement to a desired value, and concrete supply and distribution means disposed in front of the main frame for delivering said concrete mass onto the ground in front of said main extrusion plate.

2. Description of the Prior Art

Sliding shuttering machines are well known (see patents U.S. Nos. 4,073,592, 4,312,602, 4,025,217, 3,177,784 and DE 2 108 846). Among them, machines of the "Guntert and Zimmermann" type are more especially known. They are described more particularly by M. Ray and Y. Charonnat in pages 92–103 of the "Bulletin de Liaison du Laboratoire des Ponts et Chaussées" No. 95, of May-June 1968, ref 2 231. With them, concrete road surfaces, reinforced or not, may be constructed at high rates reaching 200 $m^3$ per hour with a minimum of human intervention. In the case where the concrete is not reinforced, it is poured directly in front of the machine from trucks. If the concrete is to be reinforced, the reinforcements are placed in front of the machine as it moves forward. In this latter case, the trucks no longer have direct access in front of the extrusion plate of the machine and a lateral feeding system must necessarily be used (see FIG. 9, page 104, in the above-mentioned Bulletin). Said feeding system comprises a receiving hopper offset laterally for receiving the concrete unloaded from the trucks, and supply and distribution endless belts or aprons for transporting the concrete from the receiving hopper and distributing it in front of the extrusion plate. As the machine moves forward, the longitudinal reinforcements must be positioned with regular spacing in the transversal direction over the whole width of the surface to be concreted and adjusted vertically by elements called "spacers" serving both as transverse reinforcements and as supports for the longitudinal reinforcements. Positioning of the spacers on the ground over the whole width of the surface to be concreted constitutes a difficult and delicate operation. In addition, the lateral feeding of the concrete and positioning of the reinforcements sets a problem when the width of the available space is limited (in case of motor ways), making movement of the concrete supply trucks difficult, to the extent of bringing into question the usual work rates.

SUMMARY OF THE INVENTION

The object of the present invention is to overcome these disadvantages by positioning the longitudinal reinforcements, in height and spacing, only in the immediate vicinity of the extrusion plate, without using spacers. To this end, the machine of the present invention comprises an additional extrusion plate which extends transversely between the lateral shutterings and which is situated at a distance in front of the main extrusion plate and at a height, with respect to the ground, which is lower than that of the main extrusion plate, a vibrator means mounted in front of said additional extrusion plate, a vibrator means mounted in front of said additional extrusion plate, the concrete supply and distribution means being arranged for delivering a mass of concrete on the ground also in front of the additional extrusion plate.

The present invention is based on the acknowledgement of the fact that the layer of concrete obtained on leaving an extrusion plate is sufficiently compact and hard for supporting the weight of objects laid thereon. Thus, the additional extrusion plate (first extrusion plate considering the direction of movement of the machine) which is situated one or two meters in front of the main extrusion plate (second extrusion plate considering the direction of movement of the machine), allows a first hard and compact layer to be formed which may support steel rod reinforcements or any other inserts to be embedded in the final concrete pavement, such for example as synthetic materials, paints, sealing means or other products for reinforcing the concrete structure or for improving some of the properties of the concrete structure. The main extrusion plate then allows a second concrete layer to be molded on top of the first concrete layer and of the inserts laid thereon, and to obtain the total desired thickness for the final pavement. Thus, it becomes possible to dispense with the spacers which were previously required for supporting the longitudinal reinforcements at the desired height. The result is that the problem of positioning such spacers over the whole width of the surface to be concreted is completely eliminated.

For positioning longitudinal reinforcements at regular intervals over the whole width of the surface to be concreted and for positioning them at the desired height, it is sufficient to provide guide elements, spaced apart transversely, which are fixed to the additional extrusion plate substantially in the plane of its lower face or therebelow. A transverse reinforcement dispenser may be provided immediately behind the additional extrusion plate for laying transverse reinforcements on the longitudinal reinforcements, across them, one by one at a regular spacing at a rate depending on the speed of movement of the machine.

In addition, because of the absence of spacers, it becomes possible to dispose all the longitudinal reinforcements in front of the machine between the front wheels of the auxiliary frame which supports the lateral feeding system, thus freeing a zone of appreciable width which facilitates the movement of trucks bringing the concrete to the machine, especially if the width of the available space is limited. It even becomes possible to reduce the width of the lateral feeding system and, consequently, to reduce the total width of the zone occupied by the machine and by its lateral feeding system and of the zone reserved for the movement of trucks. Therefore, the machine may operate even in places where, because of the configuration of the ground, the width of the space available is small.

BRIEF DESCRIPTION OF THE DRAWINGS

Other features and advantages of the present invention will be clear from the following description with reference to the accompanying drawings in which.

Figures 1, 2A, 2B, 2C, 3:
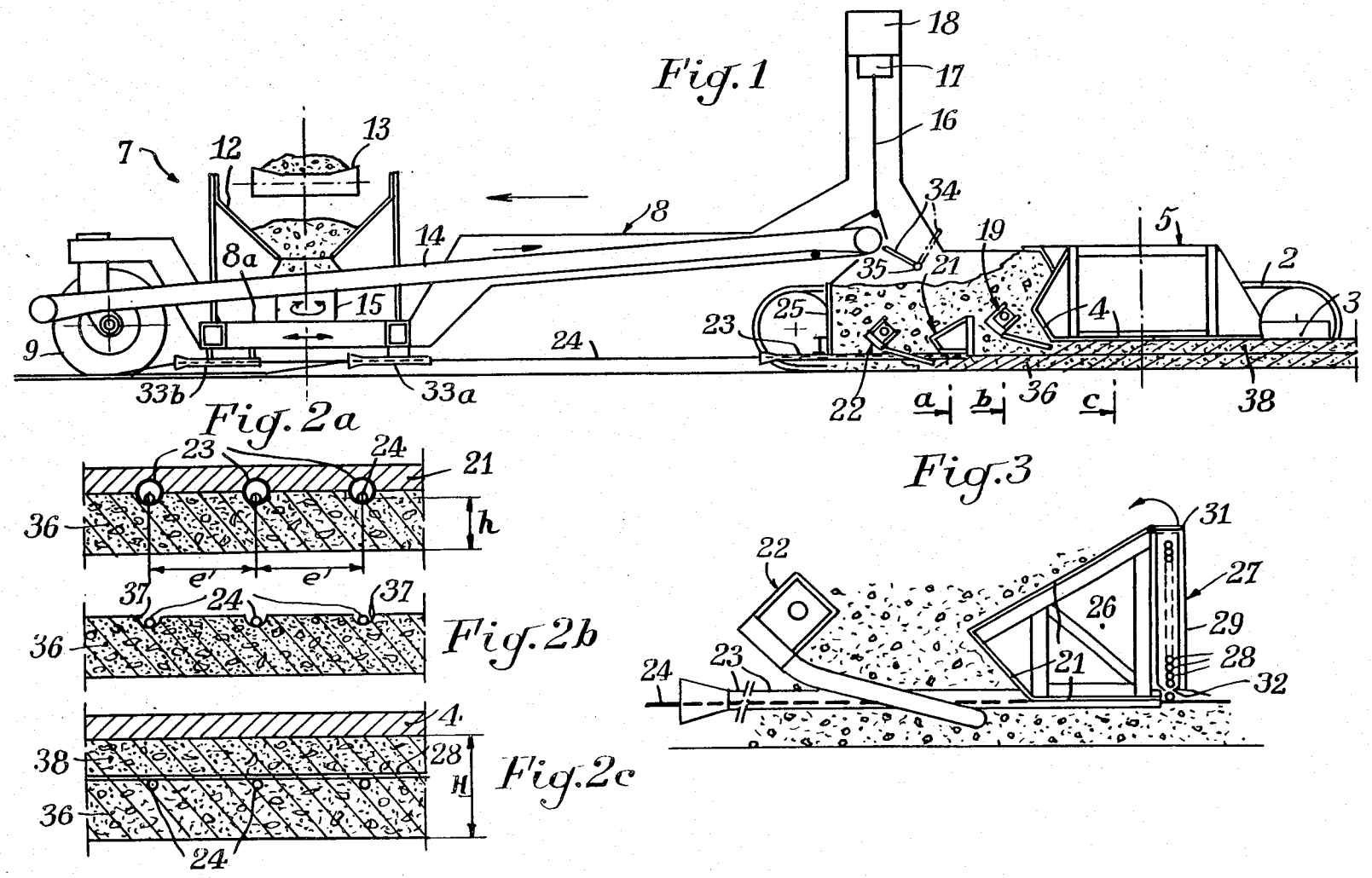
FIG. 1 is a side view diagramatically showing a sliding shuttering machine incorporating the present invention.

FIGS. *2a, 2b, 2c* are cross-section views, on a larger scale, along lines a, b and c, respectively, of FIG. 1.

FIG. 3 shows, on a larger scale, a portion of the machine of FIG. 1.

Figure 4:
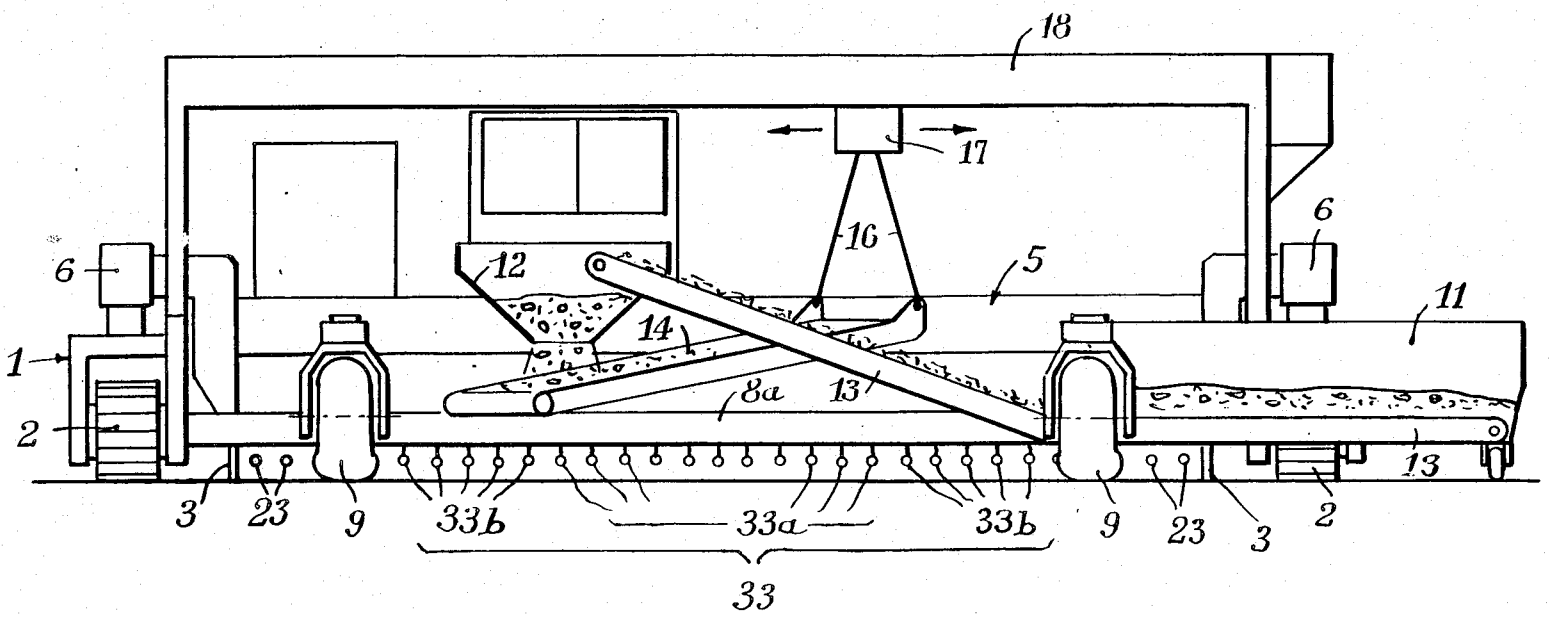
Figure 5:
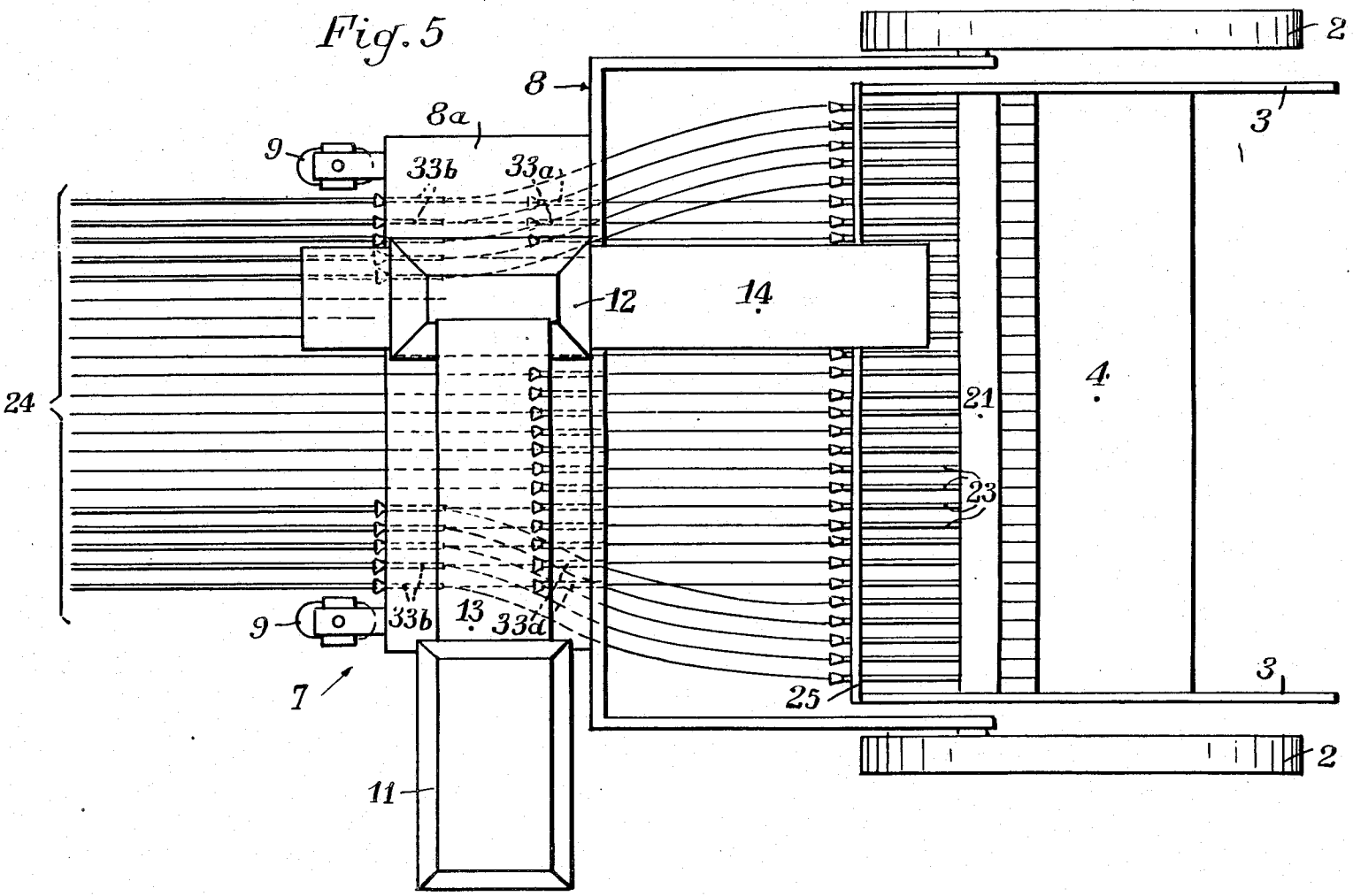

FIGS. 4 and 5 are front and top views, respectively, of the machine of FIG. 1.

FIG. 6 is a view similar to FIG. 1, showing a modified embodiment.

FIGS. *7a, 7b* and *7c* are views similar to FIGS. *2a, 2b* and *2c*, respectively, in the case of the machine of FIG. 6.

Figure 8:
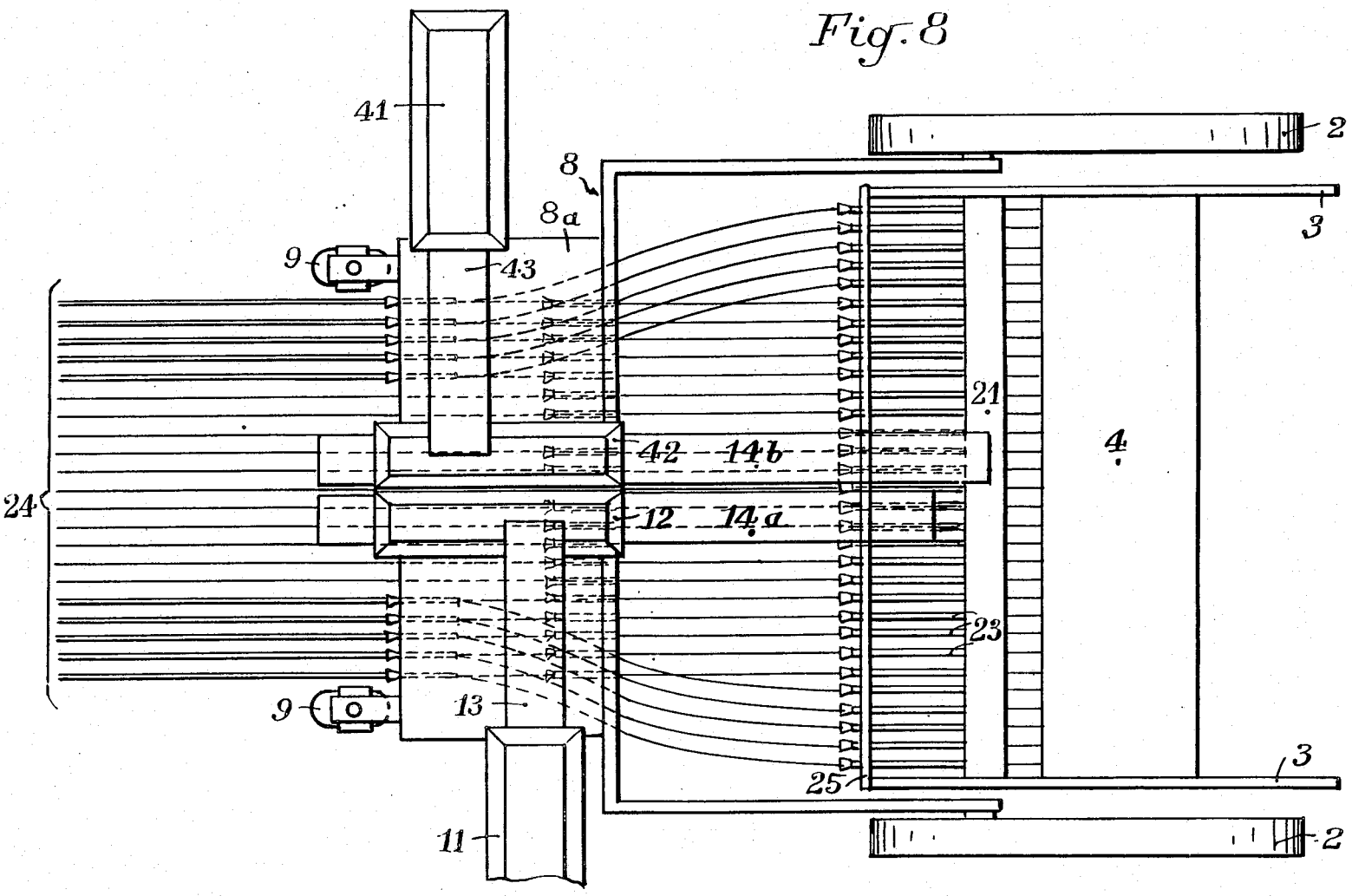

FIG. 8 is a top view of the machine of FIG. 6.

FIG. 9 is a view similar to FIG. 3 showing another embodiment of the guide elements associated with the additional extrusion plate for guiding the longitudinal reinforcements.

FIG. 10 is a perspective view showing, on a larger scale, a guide element used in the machine of FIG. 9.

FIGS. 11 and 12 show how the longitudinal reinforcements may be disengaged from the guide elements.

FIG. 13 is a sectional view along line XIII—XIII of FIG. 9, showing another detail of the machine.

DESCRIPTION OF THE PREFERRED EMBODIMENTS

The machine as shown in FIGS. 1, 4 and 5 comprises a main frame 1 equipped with caterpillar tracks 2 which are driven by a motor (not shown) and which allow the machine to move over the ground, two lateral shutterings 3, situated respectively in the vicinity of the caterpillar tracks 2, and a main extrusion plate 4 which extends transversely between the lateral shutterings 3 and which forms therewith a tunnel shaped sliding shuttering. The main extrusion plate 4 is supported by an auxiliary frame 5 which is mounted for vertical movement with respect to the main frame 1 and the vertical position of which may be adjusted by means of four hydraulic cylinders 6 (only two of the cylinders 6 are shown in FIG. 4). A servo-control system (not shown) which comprises wires stretched above the ground on each side of the machine and sensors in contact with the wires, and which acts on the hydraulic fluid supply to the cylinders 6, maintains the auxiliary frame 5 and, consequently, the main extrusion plate 4 at a level predetermined by the stretched wires and thus guarantees the uniformity of the upper surface of the concrete pavement molded by the machine despite the irregularities of the ground met by the caterpillar tracks 2 during movement of the machine.

The machine shown in FIGS. 1, 4 and 5 further comprises a lateral supply device 7 for feeding concrete to the front of the main extrusion plate 4 and for distributing it over the whole width thereof between the lateral shutterings 4. The lateral supply device 7 comprises an auxiliary frame 8 the rear end of which is connected to the main frame 1 and the front end of which is provided with two wheels 9, a receiving hopper 11 which extends laterally outwardly from one side of the front portion 8*a* of the auxiliary frame 8, another hopper 12 mounted in the front part of the auxiliary frame 8 between wheels 9, an endless belt conveyor 13 for transporting concrete from the receiving hopper 11 to hopper 12, and a distributing endless belt conveyor 14 for transporting the concrete rearwardly from the hopper 12 to a position situated in front of the main extrusion table 4. At its rear end, the distributing conveyor 14 is mounted for pivoting movement on the axuiliary frame 8 by means of a pivot shaft 15 of vertical axis and movable with respect to the auxiliary frame 8 in the longitudinal direction of the machine. At its other end the distributing conveyor 14 is suspended by cables 16 from a carriage 17 which may be reciprocated by drive means (not shown) along a transverse gantry 18 which forms part of the auxiliary frame 8.

A series of transversally spaced vibrating needles 19, intended to emulsify the concrete when they are vibrated, are mounted just in front of the main extrusion plate 4.

All the elements which have been described above are quite conventional and well known in machines of the "Guntert and Zimmerman" type, so that it is needless to describe them further in detail. A complete description of these elements and operation thereof may be found in the above-mentioned Bulletin.

In accordance with the present invention, the machine further comprises an additional extrusion plate 21 which extends transversely between the lateral shutterings 3 approximately one or two meters in front of the main extrusion plate 4 and, of course, in front of the series of vibrating needles 19. Another series of vibrating needles 22, identical to needles 19, are mounted in front of extrusion plate 21.

A set of flared tubes or trumpets 23, spaced apart transversely and in number equal to the number of longitudinal reinforcements 24 to be buried in the concrete pavement, are fixed in their rear part to extrusion plate 21 substantially in the plane of its lower face. Tubes 23 extend longitudinally and forwardly beyond the zone in which the mass of concrete is poured on to the ground by the distributing conveyor 14, and they are fixed in their front part to a vertical transverse plate 25 (FIG. 1), which defines forwardly the above-mentioned zone and which is fixed to the lateral shutterings 3. As shown in FIG. 3, tubes 23 extend rearwardly to the rear edge of extrusion plate 21.

Extrusion plate 21 is supported by an auxiliary frame 26 (FIG. 3) which is mounted for vertical movement between the lateral shutterings 3 by means of slides or other guiding means (not shown). Screw jacks (not shown), carried by the lateral shutterings 3 and actuatable manually or automatically by means of motors, allow the vertical position of the auxiliary frame 26 to be adjusted and, consequently, the vertical position of the extrusion plate 21 and tubes 23 with respect to the ground, and so the thickness of the layer of concrete extruded and molded by the extrusion plate 21.

As is also shown in FIG. 3, at the rear of the auxiliary frame 26 is fixed transverse reinforcement dispensing means 27 in which are stored transverse reinforcements 28, for example steel rods. Dispensing means 27 essentially comprises a case 29 which extends over the whole width of extrusion table 21 between the lateral shutterings 3 and which is provided, at its upper part, with a pivoting lid 31 for introducing therein a stock of transverse reinforcements 28. At its lower part, case 29 has an opening 32 situated just behind the rear edge of extrusion plate 21 and the rear orifice of tubes 23. Opening 32 is provided with a trap or flap (not shown) which is opened and closed repetitively by appropriate control members at a rate depending on the speed of movement of the machine, so as to lay the transverse reinforcements 28 one by one on the longitudinal reinforcements 24 with a predetermined spacing.

As best shown in FIG. 5, the auxiliary frame 8 has, in its front portion 8*a*, a smaller width than the distance between the lateral shutterings 3. Under the front portion 8*a* of the auxiliary frame 8 are fixed other tubes or trumpets 33, spaced apart transversely, for guiding the longitudinal reinforcements 24. The number of tubes 33 is equal to the number of tubes 23 of the first set of tubes, and they are divided into two groups, namely a first group of tubes 33*a* which are spaced transversely apart over the whole width between the wheels 9 and which are aligned axially with corresponding tubes of the first set of tubes 23 and a second group of tubes 33*b* which correspond to the remaining tubes of the first set of tubes 23 and which are offset with respect to these remaining tubes towards the median longitudinal axis of the machine so as to be located also between the wheels 9 of the auxiliary frame 8. As is more particularly visible in FIGS. 1 and 5, the second group of tubes 33*b* is situated in front of the first group of tubes 33*a*.

As shown in FIG. 1, the machine further comprises a deflector 34 which is situated immediately behind the unloading end of the distributing conveyor 14 and which may pivot about a transverse horizontal axis 35 between a first position (shown with a continuous line in FIG. 1), in which the concrete coming from the distributing conveyor 14 is directed to the main extrusion plate 4, and a second position (shown with a broken line in FIG. 1) in which the concrete is directed towards the extrusion plate 21. The deflector 34 may be mounted for pivoting either on the support structure of the distributing conveyor 14, in which case deflector 34 has substantially the same width as the distributing conveyor 14, or on the auxiliary frame 8, in which case deflector 14 extends over the whole width between the lateral shutterings 3.

The operation of the sliding shuttering machine of the present invention will now be described. The trucks back up to the receiving hopper 11 and unload the concrete therein. The concrete is then transported by the endless belt conveyor 13 to hopper 12 from where it is transported by the distributing conveyor 14 which distributes it, in combination with the deflector 34, either in front of the main extrusion table 4 or in front of the additional extrusion table 21.

With the concrete emulsified by the vibrating needles 19 and 22 situated respectively in front of the extrusion tables 4 and 21, the forward movement of the machine over its caterpillar tracks 2 causes the concrete to be "extruded" and molded to the shapes and dimensions set by each extrusion table.

FIGS. 2*a* to 2*c* illustrate the three successive phases of formation of the concrete pavement. FIG. 2*a* shows the first concrete layer 36 being formed by extrusion table 21. During this phase, the longitudinal reinforcements 24 are supported respectively by tubes 23 in which they slide freely. FIG. 2*b* is a theoretical cross section of the first concrete layer 36 in the gap between the two extrusion tables 21 and 4. As can be seen in FIG. 2*b*, the longitudinal reinforcements 24 are laid in the hollow prints or impressions left by tubes 23 during the preceding phase. The longitudinal reinforcements 24 are thus positioned perfectly in height h and in spacing e. It will be noted that behind extrusion plate 21, the transverse reinforcements 28 are laid one by one by dispenser 27 and are also perfectly positioned with even spacing in the longitudinal direction by dispenser 27. All the longitudinal and transverse reinforcements 24 and 28 rest then on the first concrete layer 36 leaving the extrusion plate 21 before entering the interplate zone where concrete is fed and vibrated in front of the main extrusion plate 4. FIG. 2*c* shows the second concrete layer 3 being formed by the main extrusion plate 4. During this phase, the second layer 38 is extruded and molded above the first layer 36 so as to reach the total thickness H desired for the reinforced concrete pavement and, simultaneously, the longitudinal and transverse reinforcements 24 and 28 are embedded between the two layers 36 and 38. The vertical position of extrusion plate 21 is for example adjusted so that the height h at which the longitudinal reinforcements 24 are located is approximately equal to half the thickness H of the final reinforced concrete pavement.

As can be seen in FIGS. 1 and 3, the additional extrusion plate 21 and the auxiliary frame 26 which supports it have a substantially smaller height than the height of the main extrusion plate 4 and of the auxiliary frame 5. Furthermore, the additional extrusion plate 21 has, in its front part and in its upper part, a wedge shape. This reduced height and this wedge shape allow the excess concrete situated in front of the additional extrusion plate 21 to pass over it towards the action zone of the main extrusion table 4. This balances the pressures which are exerted above and below the additional extrusion plate 21 and thus gains on the inertia of the structure. The result is a gain in so far as the weight of the equipment is concerned and in so far as the forces for penetrating into the mass of concrete to be extruded are concerned.

Because the sliding shuttering machine of the invention allows to dispense with the spacers which were previously required for supporting the longitudinal reinforcements 24 on the ground and which served at the same time as transverse reinforcements, all the longitudinal reinforcements 24, including the lateral reinforcements, may be fed between the wheels 9 of the auxiliary frame 8 of the lateral supply device 7. This reduces the width of the zone occupied by the longitudinal reinforcements 24 in front of the machine and, consequently, facilitates the movement of trucks. Although the lateral supply device 7 shown in FIGS. 1, 4 and 5 has, in its front part 8*a*, a width equal to that of the previously known lateral supply devices, it could have an even smaller width. The longitudinal reinforcements 24 would then be fed to the front of the machine across a zone of still narrower width and the receiving hopper 11 could then be located practically wholly in the width of the zone between the two caterpillar tracks 2. Thus, the machine could work on sites where the available space is still further restricted.

Because the sliding shuttering machine of the present invention has two extrusion plates, two different concrete layers, with or without reinforcements, can be laid one on top of the other provided that a few modifications to be described hereafter with reference to FIGS.

6 to 8 are made, whereas, previously, it was necessary to use two separate machines working one behind the other to effect this operation. The machine shown in FIGS. 6 and 8 is practically identical to the one shown in FIGS. 1, 4 and 5, except that its lateral supply device 7 comprises another receiving hopper 41, fixed to the front portion 8a of the auxiliary frame 8 and extending laterally outwardly from the other side thereof, a hopper 42 disposed adjacent to hopper 12 and another endless belt 43 which extends transversely from a location situated below the receiving hopper 41 to a location above hopper 42. It will be noted that hoppers 12 and 42 could be formed by one and the same hopper divided by a median longitudinal wall. In this machine, the distributing conveyor 14 is divided into two parts 14a and 14b which extend longitudinally side by side. Part 14a of the distributing conveyor extends from a position below hopper 12 to a position close to extrusion plate 21, in front thereof, whereas part 14b of the distributing conveyor extends from a position below hopper 42 to a position close to extrusion plate 4, in front thereof. A fixed deflecting plate 44 (FIG. 6) directs the concrete coming from part 14b of the distributing conveyor to the space between the two extrusion plates 4 and 21 and, at the same time, it separates this space from the space between it and plate 25, in which is poured the concrete coming from part 14a of the distributing conveyor.

Thus, with the machine shown in FIGS. 6 and 8, it is possible to form by means of extrusion table 21 a first layer 36 (FIGS. 7a and 7b) for example draining concrete or concrete formed of relatively large aggregates, and to form by means of extrusion table 4 a second layer or upper layer 38 (FIG. 7c) for example in richer concrete and containing hard aggregates withstanding wear better. In all cases, it is possible to insert longitudinal reinforcements 24 and transverse reinforcements 28 in the connecting plane between the two concrete layers 36 and 38.

In the foregoing description, tubes 23 provided for guiding the longitudinal reinforcements 24 are mounted under the additional extrusion plate 21 substantially in the plane of its lower face. However, they may be mounted at a distance below plate 21 so that the longitudinal reinforcements 24 are embedded at a desired depth in the first concrete layer formed by plate 21.

Another embodiment of the guide elements will now be described which, with respect to tubes 23 previously described, is advantageous in several respects, in particular from the point of view of the risk of jamming of the longitudinal reinforcements by foreign bodies, from the point of view of freeing the longitudinal reinforcements 24 with respect to the guide elements at the end of a day's work and engagement of said reinforcements in the guide elements on resumption of work, from the point of view of repairing the guide elements and from the point of view of the choice of the vertical distance with respect to the lower face of the additional extrusion plate 21.

In FIGS. 9 to 13, the elements which are identical or which have the same function as those described in connection with FIGS. 1 to 5 are designated by the same references and will not therefore be described again here in detail.

As is more particularly visible in FIGS. 9 and 10, each guide element 23 is formed by two short semi-cylindrical sections or half tubes 23a and 23b disposed longitudinally behind the other with their concave faces facing towards the longitudinal reinforcement 24 which they are to guide, so that seen along the axis of reinforcement 24, the two sections 23a and 23b completely surround reinforcement 24, see also FIG. 11.

Preferably, the total length of the two semi-cylindrical sections 23a and 23b is less than the length of the additional extrusion plate 21. The semi-cylindrical section 23a may extend forwards to a point situated behind the vibrators 22, but in the zone of action of said vibrators, whereas the semi-cylindrical section 23b may extend rearwards to a point situated outside the zone of action of said vibrators, but in front of the rear edge of the additional extrusion plate 21.

All the front sections 23a have their concave faces oriented in the same direction and are fixed to a horizontal and transverse plate 51a, whereas all the rear sections 23b have their concave faces oriented in the opposite direction and are fixed to another horizontal and transverse plate 51b. Each section 23a or 23b is welded by its upper longitudinal edge to the lower edge of a vertical and longitudinal flange plate 52a or 52b which is itself welded by its upper edge to the lower face of the corresponding plate 51a or 51b. The two flange plates 52a and 52b to which the sections 23a and 23b pertaining to one guide element 23 are fixed are situated in a same vertical plane and have a height h equal to the depth to which it is desired to embed the longitudinal reinforcements 24 in the first concrete layer formed by the additional extrusion plate 21. As a limit case, the height h may be zero and, in this case, sections 23a and 23b are welded directly to plates 51a and 51b respectively.

As is more particularly visible in FIG. 9, the additional extrusion plate 21 comprises, in its lower face, a cavity 53 adapted to receive plates 51a and 51b so that, when they are engaged in said cavity, their lower faces are flush with that of the additional extrusion plate 21 and cooperate therewith for extruding the concrete.

At least one of the two plates 51a and 51b is mounted for movement with respect to the additional extrusion plate 21 so as to free the longitudinal reinforcements 24 in a way which will now be described. In the embodiment shown in FIGS. 9, 11 and 12, the two plates 51a and 51b are mounted for movement with respect to the additional extrusion plate 21. To this end, the two plates 51a and 51b are suspended from a horizontal and transverse beam 54 respectively by links 55a and 55b the hinge pins of which are parallel to the longitudinal axis of the machine. Beam 54 is itself connected to the piston rods of at least two hydraulic actuators 56 (a single actuator is visible in FIGS. 9, 11 and 11), the cylinders of which are connected at 57 to the frame of the additional extrusion plate 21. Actuators 56 may be double acting actuators or single acting actuators associated with springs for urging and maintaining beam 54 in a high position in which plates 51a and 51b are engaged in cavity 53, i.e. in the normal working position in which plates 51a and 51b cooperate with the additional extrusion late so as to form the first or lower layer of concrete, while the guide elements 23 guide the longitudinal reinforcements 24. For freeing the longitudinal reinforcements 24, actuators 56 are actuated so as to lower beam 54 and, therefore, to disengage plates 51a and 51b from cavity 53. Plates 51a and 51b may then be moved transversely respectively in opposite directions, as shown in FIG. 12, so as to move sections 23a away from sections 23b and, consequently, so as to free the longitudinal reinforcements 24. The transverse movement of plates 51*a* and 51*b* may be effected manually or, as shown in FIG. 12 by means of hydraulic actuators 58*a* and 58*b* respectively, which are mounted between beam 54, on the one hand, and one of links 55*a* and one of links 55*b*, on the other hand, respectively. The engagement of the longitudinal reinforcements in the respective guide elements 23 may be effected by a reverse succession of the above-described operations.

From the foregoing it is clear that each pair of sections 23*a* and 23*b* provides perfect guidance of the corresponding longitudinal reinforcement 24 without any risk of jamming thereof although, in operation, concrete inevitably penetrates into the semi-cylindrical sections 23*a* and 23*b*. In fact, since these sections are open on one side, self cleaning of said sections occurs due to their relative movement with respect to the longitudinal reinforcements 24 during the forward movement of the machine.

Preferably, plates 51*a* and 51*b* are removably connected to links 55*a* and 55*b*. Thus, in case of wear or breakage of some of sections 23*a* and 23*b* or if it is desired to change the depth at which the longitudinal reinforcements are to be embedded in the first concrete layer, it is sufficient to replace plate 51*a* or plate 51*b* or both plates by one or two other plates equipped with new sections or by two other plates to which sections 23*a* and 23*b* are fixed by flange plates 52*a* and 52*b* the height h of which has another value corresponding to the desired depth, The two plates 51*a* and 51*b* may have a length such that each of them extends transversely over the whole distance between the two lateral shutterings of the machine, i.e. over the width of the concrete pavement to be formed. However, as shown in FIGS. 11 and 12, it may be advantageous for each of the two plates 51*a* and 51*b* to be in fact subdivided into two or more elementary plates disposed end to end in the transverse direction. The length and number of the elementary plates may then be chosen depending on the different widths of the concrete pavements to be formed. Furthermore, such subdivision of plates 51*a* and 51*b* into several elementary plates offers the advantage, with respect to a single plate extending over the whole width of the concrete surface to be formed, of avoiding having to change the whole of the plate if only some of sections 23*a* or 23*b* are worn. Finally, it may be desirable to embed some longitudinal reinforcements at a first depth in the layer of concrete and other longitudinal reinforcements at another depth. This may then be readily obtained by using elementary plates to which are fixed flange plates 52*a* and 52*b* the height h of which has a first value, and elementary plates to which are fixed flange plates 52*a* and 52*b* the height h of which has a second value.

As shown in FIGS. 9 and 13, the sliding shuttering machine of the present invention also comprises at least one support roller 59 which is mounted for rotation on a horizontal and transverse shaft 61 immediately in front of the zone in which the concrete mass is poured by the distributing conveyor 14 in front of the additional extrusion plate 21, which zone is defined forwardly by plate 25. Each roller 59 is formed by a tube disposed on shaft 61, which is supported at both of its ends by brackets 62 welded or fixed in any other way to plate 25. Shaft 61 may slide axially in roller 59 and in aligned holes formed in brackets 62 after removal of a retaining pin 63. Thus, by withdrawing shaft 61, roller 59 may be removed for freeing the longitudinal reinforcements 24. Normally, roller 59 is mounted so that its upper surface is situated substantially at the level of the axis of sections 23*a* and 23*b* for supporting the longitudinal reinforcements 24 at the desired height before they are guided by said sections.

The machine further comprises spacing rollers 64 with vertical axes, which are mounted for rotation at the lower part of plate 25 in the vicinity of roller or rollers 59. Rollers 64 are spaced from each other in the transverse direction by a predetermined distance corresponding to the desired spacing for the longitudinal reinforcements 24, this spacing being the same as that of the guide elements 23.

It goes without saying that the embodiments of the present invention which have been described above have been given by way of example which is purely indicative and in no wise limitative and that numerous modifications may be readily made by a man skilled in that art without departing from the scope and spirit of the invention.

What is claimed is:

1. A sliding shuttering machine for constructing continuously reinforced concrete roadways or pavements, comprising a main frame provided with transversely spaced ground engaging members allowing it to move over the ground, two lateral shutterings spaced apart transversely and extending longitudinally between the ground engaging members, a main extrusion plate extending transversely between the lateral shutterings and forming therewith a tunnel shaped sliding shuttering for extruding a mass of concrete and molding the same into a thick pavement as the machine moves forward, said main extrusion plate being mounted for vertical movement with respect to the main frame, adjustment means mounted between said main frame and said main extrusion plate for adjusting the vertical position thereof with respect to the ground and, consequently, the thickness of the concrete pavement to a desired value, concrete supply and distribution means disposed in front of the main frame for delivering said mass of concrete on to the ground in front of said main extrusion plate, an additional extrusion plate, extending transversely between the lateral shutterings and being situated at a distance in front of said main extrusion plate for extruding a mass of concrete into a first compact layer of concrete as the machine moves forward, said additional extrusion plate having a lower face which is at a height with respect to the ground which is less than that of the main extrusion plate, first vibrator means mounted in front of said additional extrusion plate, said concrete supply and distribution means being arranged for delivering a mass of concrete also in front of the additional extrusion plate, and a first set of guide elements, space apart transversely, which are mounted under said additional extrusion plate, for guiding continuous longitudinal reinforcements to be placed on top of said first layer and to be ultimately embedded in the concrete pavement.

2. The machine as claimed in claim 1, further comprising second vibrator means in the spaced between said two extrusion plates.

3. The machine as claimed in claim 1, wherein said guide elements are tubes which are fixed to said additional extrusion plate substantially in the plane of its lower face, and which extend longitudinally forwardly beyond a zone in which said mass of concrete is discharged by said supply and distribution means in front of said additional extrusion plate.

4. The machine as claimed in claim 3, wherein the tubes extend rearwardly to the rear edge of the additional extrusion plate.

5. The sliding shuttering machine as claimed in claim 1, wherein each guide element comprises two semi-cylindrical sections which are disposed longitudinally one behind the other respectively on each side of a common longitudinal axis, with their concave faces oriented towards said axis.

6. The sliding shuttering maching as claimed in claim 5, wherein the total length of the two semi-cylindrical sections is less than the length of said additional extrusion plate.

7. The sliding shuttering machine as claimed in claim 6, wherein the semi-cylindrical section the most forward of the two sections extends forwardly to a point situated behind the first vibrator means disposed in front of said additional extrusion plate, but in the zone of action of said first vibrator means, whereas the rearmost semi-cylindrical section of said two sections extends rearwardly to a point situated outside the zone of action of said first vibrator means, but in front of the rear edge of said additional extrusion plate.

8. The sliding shuttering machine as claimed in claim 5, wherein the most forward semi-cylindrical sections have their concave faces oriented in a first direction and are rigidly connected to a lower face of a first horizontal and transverse plate, whereas the rearmost semi-cylindrical sections have their concave faces oriented in an opposite direction to the first direction and are rigidly connected to a lower face of a second horizontal and transverse plate.

9. The sliding shuttering machine as claimed in claim 8, wherein each semi-cylindrical section is welded by its upper longitudinal edge to a vertical and longitudinal flange plate which has a predetermined vertical dimension and which is itself welded to the lower face of said horizontal and transverse plate.

10. The sliding shuttering machine was claimed in claim 8, wherein at least one of the first and second horizontal and transverse plates is mounted for movement with respect to said additional extrusion plate to allow each pair of semi-cylindrical sections to release the corresponding longitudinal reinforcement.

11. The sliding shutterning machine as claimed in claim 10, wherein said additional extrusion plate comprises, in its lower face, a cavity adapted to receive said first and second horizontal and transverse plates so that, when they are engaged in said cavity, their lower faces are flush with that of the additional extrusion plate and cooperate therewith for extrusion the concrete, said machine further comprising a horizontal and transverse beam situated above the first and second horizontal and transverse plates, lifting means mounted between a frame of said additional extrusion plate and said beam, and links connecting each of the first and second horizontal and transverse plates to said beam, said links having hinge axes which are parallel to the longitudinal axis of the machine.

12. The sliding shuttering machine as claimed in claim 11, wherein each of said two horizontal and transverse plates is removably connected to the corresponding links.

13. The sliding shuttering machine as claimed in claim 5, further comprising at least one support roller mounted for rotation on a horizontal and transverse shaft immediately in front of the zone in which the mass of concrete is poured by the supply and distribution means in front of said additional extrusion plate, said support roller having an upper surface situated substantially at the level of the axes of the semi-cylindrical sections for supporting the longitudinal reinforcements at a desired height before they are guided by said semi-cylindrical sections, said shaft being removably supported in transversely spaced apart brackets of said main frame.

14. The sliding shuttering machine as claimed in claim 13, further comprising spacing rollers of vertical axes, which are mounted for rotation on said frame in the vicinity of said support roller and which are spaced from each other by a predetermined distance corresponding to the desired spacing between the longitudinal reinforcements.

15. The machine as claimed in claim 1, further comprising a transverse reinforcement dispenser which is disposed immediately behind said additional extrusion plate and which is capable of laying transverse reinforcements on said longitudinal reinforcements, thereacross, one by one at a rate depending on the speed of movement of the machine.

16. The machine as claimed in claim 1, wherein said concrete supply and distribution means comprises an auxiliary frame having a rear portion connected to the main frame and a front portion having a smaller width than the distance between the lateral shutterings, the front portion of the auxiliary frame being provided with ground engaging wheels which are spaced apart transversely by a distance less than the distance between the lateral shutterings, a first hopper fixed to the front portion of the auxiliary frame and extending transversely outwardly from a side thereof, a second hopper mounted on the front portion of the auxiliary frame between the wheels thereof, a conveyor which extends transversely from a position below the first hopper to a position above the second hopper, a distributing conveyor which extends longitudinally rearwardly from a position below the second hopper to a position close to said additional extrusion plate, said distributing conveyor being mounted for pivoting movement about a vertical axis at its end adjacent the second hopper, and reciprocating means connected to the other end of the distribution conveyor for reciprocating it between the two lateral shutterings.

17. The machine as claimed in claim 16, further comprising a set of guide tubes for the longitudinal reinforcements, in number equal to that of the guide elements, which are spaced transversely apart and which extend longitudinally below the front portion of the auxiliary frame, to which they are fixed, said set of tubes comprising a first group of tubes which are situated between the wheels of the auxiliary frame and aligned axially with corresponding guide elements, and a second group of tubes which correspond to the remaining guide elements and which are offset with respect to said remaining guide elements towards the longitudinal median axis of the machine so that they also are located between the wheels of the auxiliary frame.

18. The machine as claimed in claim 17, wherein the tubes of said second group are situated in front of the tubes of said first group.

19. The machine as claimed in claim 16, wherein the concrete supply and distribution means comprise a deflector means which is situated immediately behind said other end of the distributing conveyor and which is pivotable between a first position in which the concrete from the distribution conveyor is directed towards the main extrusion plate, and a second position in which the concrete is directed towards the additional extrusion plate.

20. The machine as claimed in claim 16, wherein said concrete supply and distribution means comprise a third hopper fixed to the front portion of the auxiliary frame and extending laterally outwardly from the other side thereof, a fourth hopper adjacent to the second hopper, and another conveyor which extends transversely from a position below the third hopper to a position above the fourth hopper, said distributing conveyor being divided into two parts which extend longitudinally side by side, one of the two parts extending from a position below said second hopper to a position close to said additional extrusion plate, in front thereof, the other part extending from a position below said fourth hopper to a position close to said main extrusion plate, in front thereof.

* * * * *